United States Patent [19]

Accattato

[11] Patent Number: 4,966,673

[45] Date of Patent: Oct. 30, 1990

[54] DEVICE FOR CLEANING AND POLISHING JEWELRY

[76] Inventor: Carlo Accattato, 15 McLaughlin Ave., West Haverstraw, N.Y. 10977

[21] Appl. No.: 343,803

[22] Filed: Apr. 26, 1989

[51] Int. Cl.[5] ..... C25F 7/00; C25F 1/00; C25F 3/00

[52] U.S. Cl. ..... 204/224 M; 204/228; 204/241; 204/271; 204/274; 204/287; 204/285

[58] Field of Search ..... 204/141.5, 224 M, 228, 204/271, 274, 241, 287

[56] References Cited

U.S. PATENT DOCUMENTS

| | | | |
|---|---|---|---|
| 2,505,228 | 4/1950 | Chase | 204/271 |
| 2,771,415 | 11/1956 | Ross | 204/287 X |
| 3,457,151 | 7/1969 | Kortejarvi | 204/141.5 X |
| 3,497,445 | 2/1970 | Berglund et al. | 204/225 X |
| 3,703,458 | 11/1972 | Read et al. | 204/287 X. |

*Primary Examiner*—Donald R. Valentine
*Attorney, Agent, or Firm*—McGlew & Tuttle

[57] ABSTRACT

The invention provides a jewelry cleaning arrangement including a housing and a cleaning bath tank formed of an electrically conductive material. The cleaning bath tank is supported within the housing and is connectable to an electric potential. An electrical contact member extends sealingly into the interior region of the tank. The electrical contact member is electrically insulated from the tank and is connectable to an electric potential. A non-conductive insert member is positionable in the tank and movable between a cleaning position and an elevated position. The non-conductive insert member includes a support surface upon which jewelry may be placed. A jewelry engagement conductive member is provided supported on the non-conductive insert member support surface. The jewelry engagement member includes a contact portion engaging the electrical contact member when the insert member is positioned in the cleaning position within the tank. The cleaning tank is fillable with conductive fluid to allow electrolytic action betweeen the tank and the jewelry to be cleaned with the jewelry being placed at negative potential and the tank being placed at positive potential.

18 Claims, 6 Drawing Sheets

54
56
58
18
20
48
22
120
118
116
114
119
112
14
12
106
92
36
10
16
124
126

DEVICE FOR CLEANING AND POLISHING JEWELRY

BACKGROUND OF THE INVENTION

The present invention relates to a device for cleaning and polishing jewelry and the like and more particularly, to a compact jewelry cleaning arrangement including an electrocleaning device for use by jewelers and the like.

Field of the Invention

In the past, jewelry, precious gems and metals have been cleaned by various processes. These processes include electropolishing, ultrasonic cleaning, chemical action cleaning and other processes.

U.S. Pat. No. 4,663,005 issued May 5, 1987 to Edson teaches an electrolytic process employing a non-toxic electrolytic solution. This reference teaches some of the basic concepts of electrocleaning and is specifically directed to a solution to be used in the basic electrocleaning process. Such a process necessarily has its drawbacks relating to the removal of amounts of the metal being cleaned. This results in the obvious drawback of loss of some of the precious metal forming the piece of jewelry Additionally, problems have been experienced with regard to production of the metal adjacent gemstones or the like forming a part of the jewelry. This often causes the gems to be loose in their fittings and sometimes results in the stones being detached from a metal support. Additional significant problems arise in using an electropolishing process in small scale operations such as cleaning jewelry (as opposed to cleaning steel or the like, on an industrial level). Electrostripping (jewelry act as anode at negative potential) causes problems due to the large amount of current drawn during the process. The process can often be dangerous to a user especially when dealing in small scales with arrangements including burners, conductive beakers and power supplies with lead lines going to the jewelry and the conductive beaker.

Ultrasonic cleaning has been used in the jewelry fields due to its ease of use in small scale operation such as the cleaning of jewelry (as opposed to the cleaning of steel or the like in industrial settings). Such ultrasonic arrangements may be sized for the cleaning of individual jewelry items and may be easily used with little danger to a jeweler or operator of the equipment. Unfortunately, ultrasonic cleaning tends to damage jewelry and particularly damages jewelry with gemstone settings and the like. Ultrasonic cleaning tends to vibrate the stones to either cause the stones to be disengaged from the jewelry setting or to become chipped or cracked as a result of the ultrasonic cleaning. Accordingly, ultrasonic cleaning provides a convenient arrangement but, the damage to jewelry is unacceptable, especially the damage to the jewelry after repeated ultrasonic cleanings.

Thermal and chemical action has been employed to clean metal and stones for some time. Unfortunately, the use of chemicals and thermal action on a small scale tends to be dangerous due to the high heat levels and the caustic nature of the chemicals. Additionally, chemical and thermal action tends to erode the metals and can significantly damage jewelry over time. As with other processes, chemical action tends to lessen gemstones mounted in metal settings of the jewelry. Such thermal chemical processes may include alkaloid or acid substances which act on the metal or gem surface to result in cleaning action.

The known processes suffer from several different problems. The electrostripping processes tend to be awkward and extremely dangerous when used to clean jewelry and the like. Accordingly, electrostripping is more often used in industrial metallurgical processes. Ultrasonic cleaners readily adapt to use by jewelers due to the known compact arrangements which are safe and easy to use. Unfortunately, ultrasonic cleaners tend to damage jewelry to a great extent and do not provide the desirable cleaning effect which the electrostripping processes provide.

SUMMARY OF THE INVENTION

It is an object of the invention to provide a jewelry cleaning arrangement adapted to be used by jewelers to clean small amounts of jewelry in a non-industrial setting, wherein the jewelry cleaning arrangement is simple to operate, safe to operate and effective in cleaning jewelry without damaging the jewelry.

Another object of the invention is to provide a cleaning arrangement which will clean combinations of metals and stones or gems such as jewelry, in a safe manner without damage to the stone and gems and particularly without damaging the settings providing the connection between the stones and gems.

It is still a further object of the invention to provide a cleaning arrangement which will remove unwanted dirt on jewelry or the like by a combined chemical, thermal, and electroprocess which would not result in erosion on metallic surfaces of the jewelry or the like.

According to the invention, a jewelry cleaning arrangement is provided including a housing supporting a cleaning arrangement is provided including a housing supporting a cleaning bath tank. The cleaning bath tank is formed of an electrically conductive material with the tank connectable to an electrical potential. Heating element means is provided for heating fluid disposed within the tank. The heating element preferably extends up from a bottom portion of the tank into the interior region of the tank. An electrical contact member extends sealingly into th interior region of the tank. The electrical contact member is electrically insulated from the conductive tank. A non-conductive insert member is positionable in the tank spaced from the heating element means. The non-conductive insert member includes a support surface to support jewelry or the like. Conductive jewelry engagement means is provided supported by the non-conductive insert. The jewelry engagement means includes a contact portion engaging the electrical contact member when the insert member is positioned within the tank. The jewelry engagement means provides electrically conductive engagement with the jewelry to be cleaned to provide electrolytic action between the jewelry (cathode) and conductive tank (anode) when a tank is filled with a conductive fluid.

The arrangement preferably additionally includes a thermostat provided to regulate the heating of the conductive fluid. An additional insert is preferably provided for electrical contact with odd-shaped jewelry or the like. Such additional insert may be formed of a non-conductive material with a conductive screen material forming a platform of the additional insert. Additional insert electrical contact means are preferably provided attached to the additional support. The additional support preferably includes engagement means for engagement with the non-conductive insert. The additional insert contact member contacts the conductive jewelry engagement means when the additional insert member engagement mean is connected to the non-conductive insert member. With this arrangement, odd-shaped jewelry may be placed on the conductive screen material of the additional insert and be connected to the negative potential of the jewelry cleaning arrangement.

The invention advantageously provides engagement means associated with the non-conductive insert for engaging a connection means associated with the tank. The engagement means of a non-conductive insert is preferably a slot portion adapted to receive a rail portion associated with the tank. The slot portion engages the rail portion allowing the non-conductive insert to be lowered into the tank assuring contact between the contact portion of the jewelry engagement means and the electrical contact member extending sealingly into the interior region of the tank.

The present invention provides several features to insure a safe and thorough cleaning of jewelry. The housing is provided with a lid adjacent the cleaning bath tank hingedly mounted for movement between an open position and a closed position. The inside of the lid is provided with a hinge connection hingedly supporting an attachment member. The attachment member is hingedly connected to a hinge connection provided on the inside of the non-conductive insert. This arrangement provides a safety cleaning disengagement means lifting the non-conductive insert out of the cleaning bath tank upon the opening of the lid member. As the non-conducting insert is lifted, the contact portion of the jewelry portion engagement mean becomes electrically disengaged from the electrical contact member. Additionally, the liquid solution provided in the cleaning bath tank drains out of the non-conductive insert through the openings provided in the support surface of the non-conductive insert member. In this way, the jewelry may only be accessed in a safe manner with the non-conductive insert jewelry engagement means being electrically disengaged and with the non-conductive insert member being free of liquid in a position allowing a user easy access to the jewelry. The arrangement provides extremely smooth movement action due to the provision of the rail and slot engagement between the non-conductive insert and the tank.

Unlike other jewelry cleaning arrangements which utilize electrolytic action, the device of the present invention employs a cathodic electrocleaning or electroplating arrangement. Such an arrangement connects the jewelry such that it acts as a cathode causing positively charged ions colloidal particles to migrate through the tank from anode (tank wall) to cathode. This arrangement provides a cleaning action without any damage to the piece of jewelry. That is, ions which migrate towards the jewelry do not attach to the jewelry itself, but attach to non-metallic particles (such as carbon pigments), soaps and other colloidal substances, forming a smut. Accordingly, the jewelry piece is free from damage. During the electrocleaning process, the liquid forming the cleaning bath acts on the jewelry under the electrolytic action causing bubbling adjacent the jewelry which, in turn, acts to dislodge non-metallic particles (such as carbon pigments, soaps and the like) and to remove them from the jewelry. The suggested conductive liquid includes a mixture of water and a commercially available electro-cleaning substance sold under the name OAKITE 90. This substance includes a mixture of an-ionic and non-ionic surfactants and alkalis including caustic soda, silicates and phosphates. The conductive bath is heated by a heater and thermostat arrangement to maintain the liquid at a desirable temperature of approximately 180° F. The inventive arrangement includes steam generating means and means for ejecting steam for the further cleaning of the jewelry piece.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DESCRIPTION OF THE PREFERRED EMBODIMENT

Figure 1:
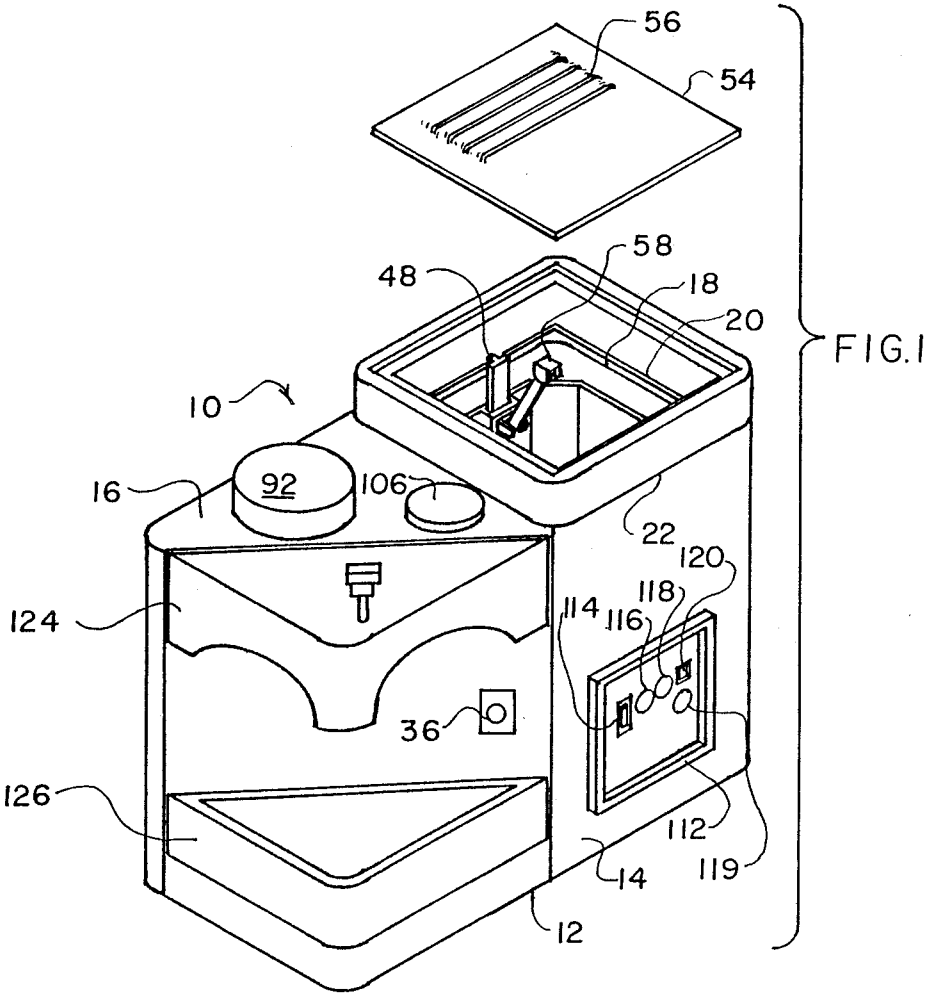
FIG. 1 is a perspective view of an arrangement according to the present invention with a lid part removed to show portions of the interior.
Figure 3:
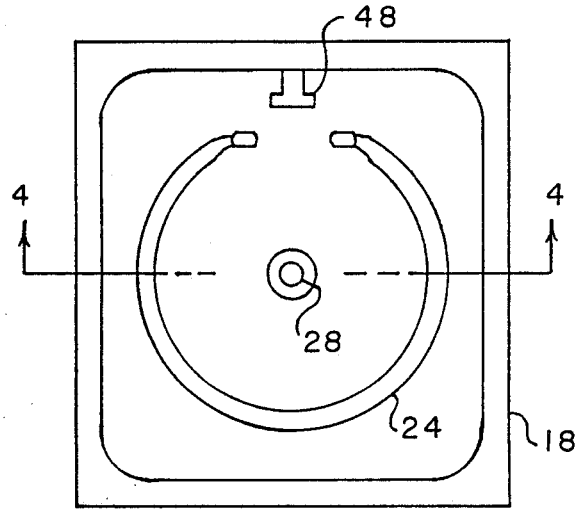
FIG. 3 is a top plan view of a cleaning bath tank according to the invention.
Figure 4:
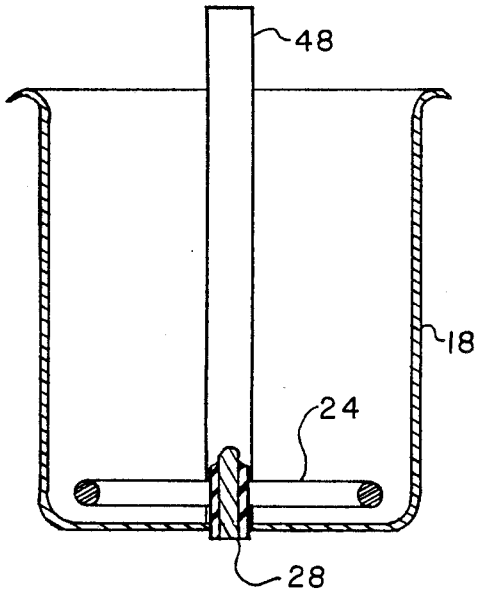
FIG. 4 is a cross sectional view taken in the direction of line 4—4 of FIG. 3.
Figure 7:
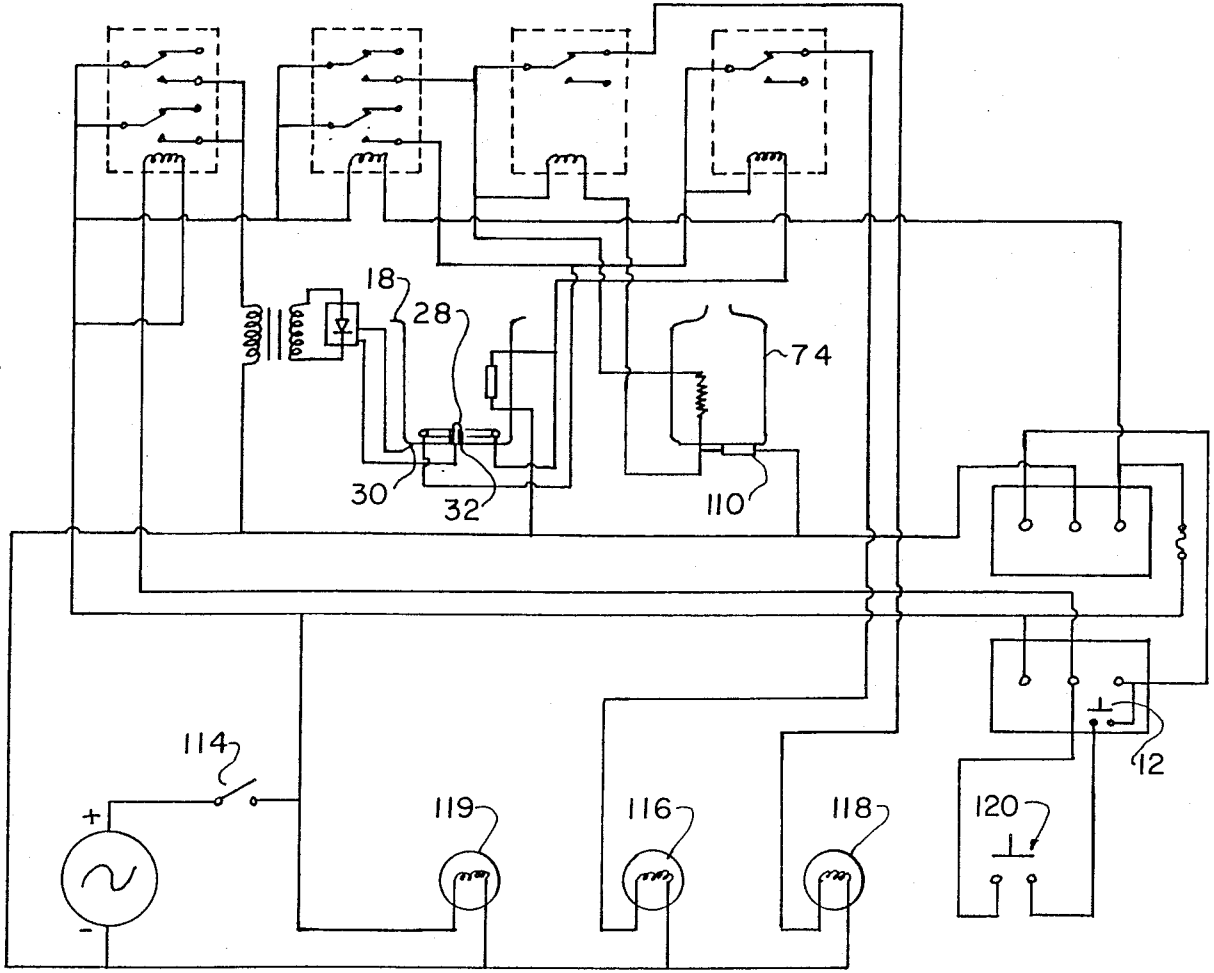
FIG. 7 is a schematic view of the electrical system according to the invention.
Figure 8:
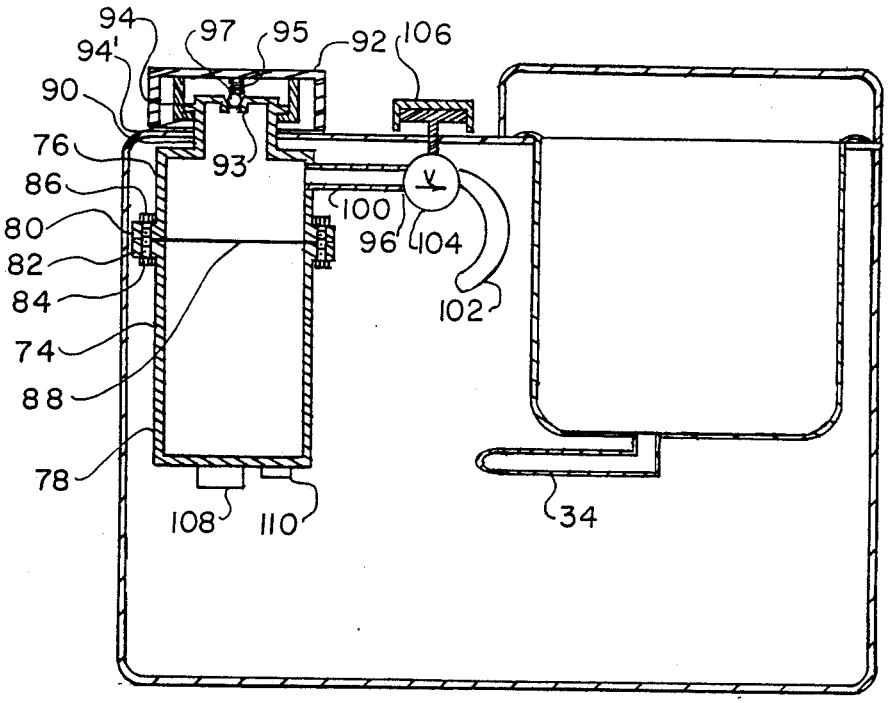
FIG. 8 is a cross-sectional view taken in the direction of line 8—8 of FIG. 2 showing the steam generating arrangement.

Referring to the drawings, in particular, the invention embodied therein as shown in FIG. 1 comprises a cleaning device generally designated 10, for cleaning and polishing jewelry. The cleaning device 10 includes a housing 12 having a whirl pool electrocleaning side 14 and a steam side 16. An electrically conducting tank 18, advantageously made of stainless steel, is inserted into a hole 20 in a top surface 22 in the housing 12. As best seen in FIGS. 3, 4, and 8, the cleaning tank 18 has a heating element 24 disposed at the bottom of the tank 18. The tank 18 also includes a thermostat 26 for measuring the temperature of a liquid in the tank 18. Electrically insulated from the tank 18 is an electric contact or stud 28 protruding through the bottom of the tank 18. As best seen in FIG. 7, the tank 18 is electrically connectable to a positive potential at contact point 30, and the electrical contact stud 28 is electrically connectable to a negative electrical potential at 32.

Connected to the tank 18 is a drain line 34 which extends toward a drain spout 36 for easy removal of the liquid in the tank 18.

Figure 5:
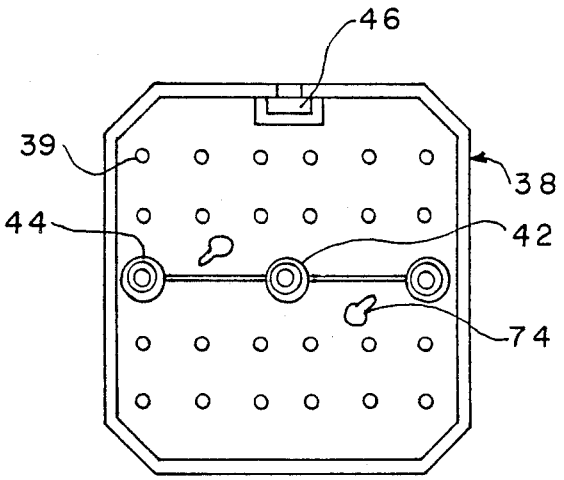
FIG. 5 is a top plan view of a primary insert according to the invention showing how the additional insert is advantageously placed into the primary insert.
Figure 6:
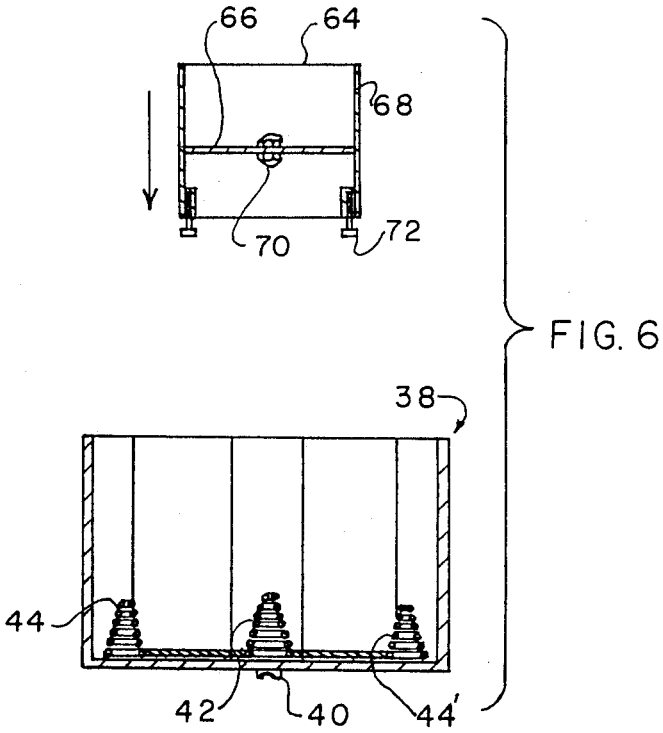
FIG. 6 is a cross-sectional view of an additional insert according to the invention.

As best shown in FIGS. 5 and 6, there is provided a nonconductive primary insert 38 which is submergible in the cleaning tank 18. Arranged at the bottom of the primary insert 38 is a bottom electrical contact 40 which makes electrical contact with stud 28 when the primary insert 38 is submerged in tank 18. Electrically connected to the bottom electrical contact 40 and extending upward into the primary insert 38 is a spring contact 42. Jewelry may be engaged by the spring contact 42 thereby placing the jewelry at the same electrical potential as stud 28. Arranged on either side of the spring contact 42 and electrically connected to spring contact 42 are additional contacts 44 to receive jewelry.

The primary insert 38 has a number of perforations, or openings, 39 to enable the liquid to enter into the primary insert 38, allowing the insert 38 to be easily submerged in the cleaning tank 18 even when it is filled with liquid.

Arranged on one side of the primary insert 38 is a box shaped slide connector 46, which can be arranged to fit slidably over a T-bar 48 which is connected to the tank 18. The T-bar/slide connector 48-46 arrangement enables smooth upward and downward movement of the primary insert into and out of the tank 18.

Figure 10:
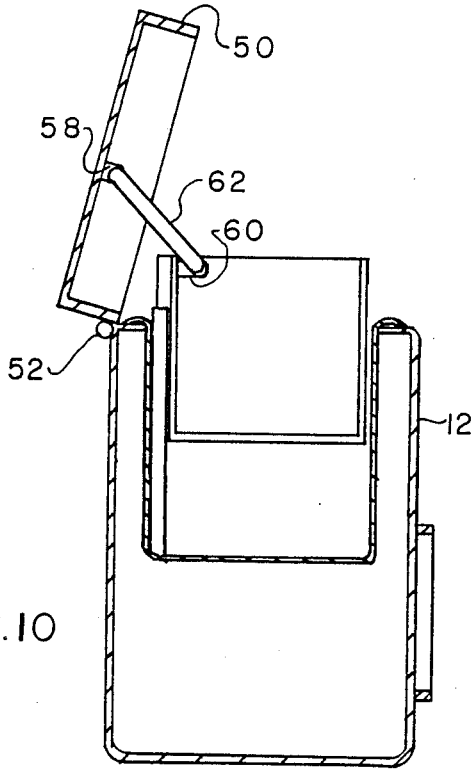
FIG. 10 is a cross sectional view taken in the direction of the line 10—10 of FIG. 2 with the lid in an open position.

As best seen in FIG. 10 a lid 50 is connected to housing 12 by hinges 52. The lid 50 contains a top portion 54 with gills 56 to vent the cleaning bath 18.

The lid top portion 54 is fixed to a top connector piece 58. The primary insert 38 is connected to a bottom connector piece 60. Pivotally connected at one end to the top connector piece 58 is a link or attachment member 62. Link 62 is pivotally connected at a second opposite end to the bottom connector piece 60. The opening of the lid 50 causes the primary insert 38 to raise upward and out of the liquid in the cleaning bath 18. By this arrangement, access to the jewelry is only possible when the non-conductive insert 38 is raised allowing the conductive fluid to drain through holes 39 provided in a support surface of the non-conductive primary insert 38. When the non-conductive primary insert 38 is raised, the bottom electrical contact 40 becomes electrically disengaged from the electrical contact stud 28. Accordingly, in the raised position, the jewelry is out of electrical contact and most of the bath fluid has been drained out of the primary insert 38.

To receive smaller jewelry or odd-shaped jewelry items there is provided a secondary insert 64 with an electrically conducting screen 66 arranged within a cylinder formed by vertical side wall 68. Arranged at a center portion of the screen 66 is a secondary contact 70. The secondary insert 64 is placed inside the primary insert 38 by inserting attachment studs 72 arranged at the bottom of the secondary insert 64, inside key shaped lock sockets 74 in the primary insert 38. The lock sockets 74 have a wide portion and a thin portion. When the attachment studs 72 are fitted through the wide portion of the lock sockets 74 and the secondary insert 64 is rotated slightly to fit the studs 72 into the thin portions of the lock socket 74, the secondary insert 64 becomes fixedly attached to the primary insert 38. The secondary contact 70 thereby makes electrical contact with the spring contact 74, putting the screen 66 at the electrical potential of stud 28.

The electrically conductive tank 18 is filled with a mixture of water and a conductive fluid such as a commercially available product sold under the trade name OAKITE 90 powdered alkaline material designed to anodically remove smut, oil and the like. This substance includes a blend of an-ionic and non-ionic surfactants and alkalis including caustic soda, silicates and phosphates. A portion of this substance mixed with water provides the electrically conductive fluid and also helps generate bubbling adjacent the jewelry to help remove carbon pigments and the like.

As best seen in FIG. 8 a steam tank 74 is disposed within the steamer side 16 of the housing 12. The steam tank 74 includes a top portion 76 and a bottom portion 78. The top portion 76 has a bottom flange 80, and the bottom portion 78 has a top flange 82. The top portion 76 is attached to the bottom portion 78 at flanges 80, and 82 by a nut 84 and bolt 86 arrangement.

Arranged between the bottom flange 80 and the top flange 82 is a safety gasket 88, which is of limited strength so that the gasket 88 will become damaged and allow steam to escape from the steam tank 74, should the steam tank 74 experience excess pressure.

Arranged at the top of steam tank 74 is a fill spout 90 which extends through the top surface 22 of the housing 12. Removably arranged over the fill spout 90 is a fill cap 92. The fill spout 90 and the fill cap 92 each have corresponding flanges 94 and 94' which can be lockedly engaged to sealingly secure the fill cap 92 over the fill spout 90

Figure 2:
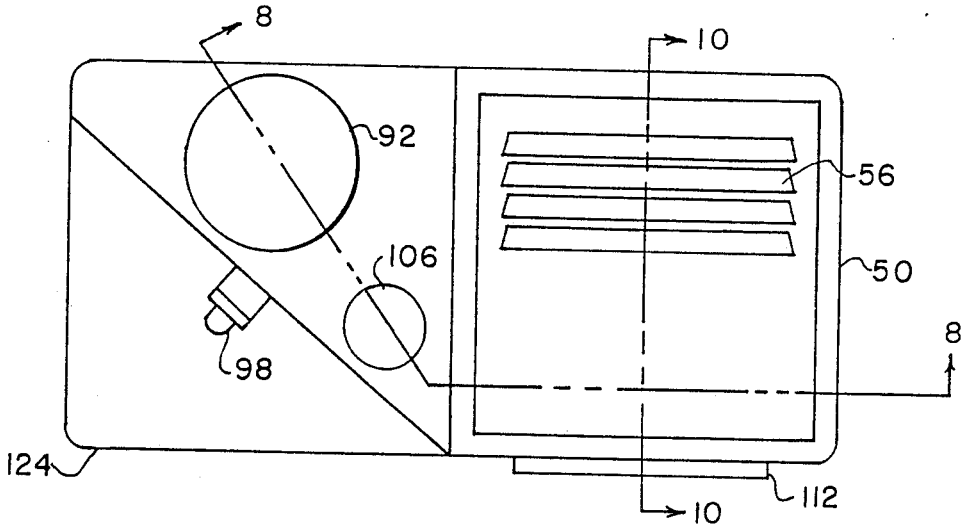
FIG. 2 is a top plan view of the device according to the invention.

The cap 92 includes pressure release valve 93 with a spring 95 and ball 97 arrangement to release pressure inside the steam tank 74. Extending from the steam tank 74 is a steam line 96 which terminates in a nozzle portion 98 (see FIGS. 1, 2, and 9) on the outside of the housing 12. The steam line 96 advantageously includes a steam conduit 100 and a flexible hose 102 with a valve 104 arranged therebetween. To control the valve 104 and thereby the steam leaving through nozzle portion 98, there is provided a control knob 106 on the top surface 22 of the steamer side 16. Arranged at the bottom of the steam tank 74 is a heating element 108 for heating the water in the steam tank 74. Disposed outside the steam tank, on the bottom, is a thermostat 110 for measuring the temperature inside the steam tank 74.

Figure 9:
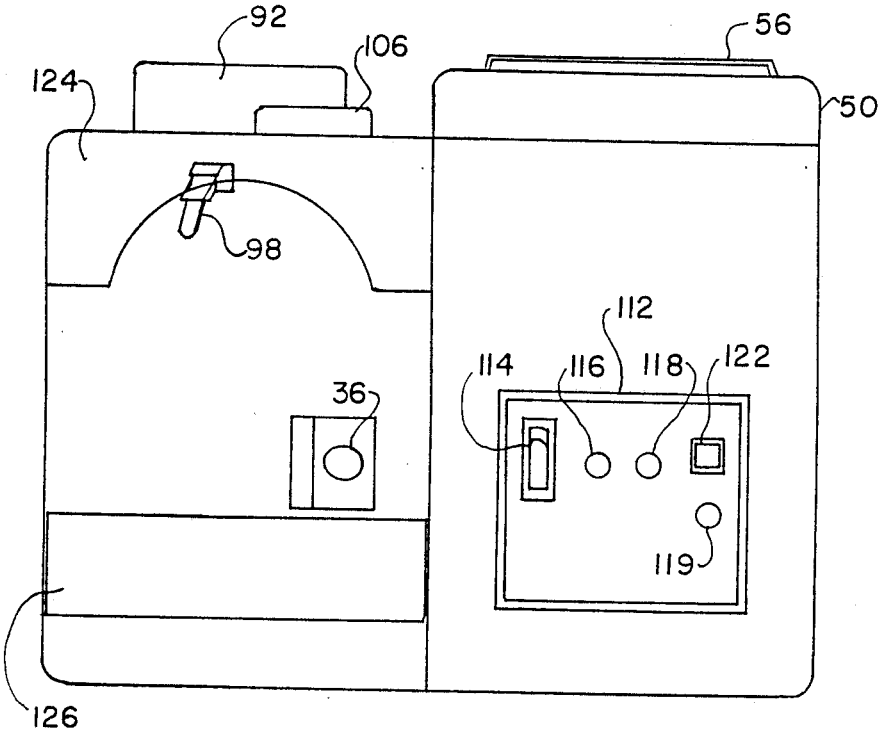
FIG. 9 is a front plan view of the device of the present invention.

As best seen in FIGS. 1 and 9, a control panel 112 is arranged on a front face of the housing 12. Referring also to FIG. 7 the control panel 112 includes an activation switch 114 which supplies power to heating element 24 in tank 18, and heating element 108 on steam tank 74. Included on the control panel 112 is activation light 119 which indicates that the device is on. When the temperature in the cleaning tank 18 reaches a selected temperature whirlpool indicator light 116 on the control panel 112 lights up. Similarly, when the thermostat 110 in steam bath 74 senses a preselected temperature in the steam tank 74 a steam tank indicator light 118 lights up on the control panels 112.

With the jewelry placed in the primary insert 38 or secondary insert 64 and the whirlpool indicator light 116 is lit the cleaning switch 120 is closed, advantageously in the form of a push button 122 on control panel 112. With the cleaning switch closed cleaning tank 18 receives a positive electrical potential at contact 30, as discussed above and stud 28 receives a negative potential at contact point 32. There is provided a timer 123 to discontinue the current needed to supply the respective electrical potential to the tank 18 and the stud 28, after a preselected time period.

After the electrocleaning is complete the jewelry is removed from the cleaning tank 18 and held under nozzle 98 while knob 106 is rotated thereby providing steam to the jewelry under steam hood 124. The steam hood is advantageously made of a transparent material. There is also provided a removable rinse tank 126 below nozzle 98 to catch any water or smut falling from the jewelry, or the nozzle 98.

While specific embodiments of the invention have been shown and described in detail to illustrate the application of the principles of the invention, it will be understood that the invention may be embodied otherwise without departing from such principles.

What is claimed is:

1. A jewelry cleaning arrangement comprising:

a housing;

a cleaning bath tank formed of an electrically conductive material, said cleaning bath tank being supported within said housing, being connectable to an electric potential and being fillable with fluid;

an electrical contact member extending sealingly into the interior region of said tank, said electrical contact member being electrically insulated from said tank and being connectable to an electric potential;

a non-conductive insert member positionable in said tank spaced from a bottom portion of said tank, said non-conductive insert member including a support surface;

jewelry engagement conductive means, supported by said non-conductive insert, said engagement means including a contact portion engaging said electrical contact member when said insert member is positioned within said tank, said jewelry engagement means for electrical conductive engagement with jewelry to be cleaned, whereby said cleaning tank is filled with a conductive fluid to allow electrolytic action between said tank and the jewelry to be cleaned.

2. A jewelry cleaning arrangement according to claim 1, further comprising: an additional insert member including additional insert connection means for connection with a cooperating connection means associated with said non-conductive insert member, an additional insert contact, said additional insert contact abutting said jewelry engagement conductive means when said additional insert is connected to said non-conductive insert member, said additional insert including a non-conductive retaining wall and a conductive fluid permeable structure supported by said retaining wall, said conductive structure being in electrical connection with said additional insert contact to provide electrical connection between said electrical contact member and said additional insert conductive member.

3. A jewelry cleaning arrangement according to claim 2, wherein said cooperating connection means associated with said non-conductive insert member includes a plurality of slots with a large slot portion and a small slot portion, said additional insert connection means including attachment studs with enlarged end portions, said enlarged end portions passing through said large slot portions, said additional insert member being rotatable such that said attachment stud member are engaged by said small slot portions.

4. A jewelry cleaning arrangement according to claim 2, wherein said conductive fluid permeable structure includes a conductive metallic mesh.

5. A jewelry cleaning arrangement according to claim 1, further comprising: safety disengagement means for moving said non-conductive insert from a position within said tank wherein said jewelry engagement contact portion is electrically engaged with said electrical contact member to an elevated position wherein said jewelry engagement contact portion is electrically disengaged, said non-conductive insert member lying above a level of the fluid disposed in said tank in said elevated position.

6. A jewelry cleaning arrangement according to claim 5, wherein said safety disengagement means includes a lid hingedly connected to said housing positioned above said cleaning bath tank, said lid being movable between a first forward position and second elevated position, guide means including a first guide member connected to said tank and a second guide member connected to said non-conductive insert, said first and second guide members cooperating to provide a vertical guide for guiding said non-conductive insert member as it is moved from a lower position to an elevated position and pivotal connection means connected between said non-conductive insert member and said lid for moving said non-conductive insert member to said elevated position upon opening said lid.

7. A jewelry cleaning arrangement according to claim 1, further comprising: heating element means for heating fluid disposed in said tank.

8. A jewelry cleaning arrangement according to claim 7, further comprising a thermostat for sensing the temperature of fluid in said tank and for regulating said heating means to maintain the fluid in said tank in a predetermined selected temperature range.

9. A jewelry cleaning arrangement according to claim 1, wherein said electrical contact member extends through a bottom portion of said cleaning bath tank and includes an electrical contact stud extending outwardly in the interior of said cleaning bath tank.

10. A jewelry cleaning arrangement according to claim 1, wherein said jewelry engagement conductive means includes a conductive spring member which is extensible and contractible to grasp and electrically engage jewelry to be cleaned.

11. A jewelry cleaning arrangement according to claim 1, wherein said tank is formed of stainless steel and said electrical contact member includes a gold-plated stud member.

12. A jewelry cleaning arrangement according to claim 1, wherein said non-conductive insert member support surface defines a plurality of holes allowing fluid to pass from below said support surface to above said support and from above said support surface to below said support surface.

13. A jewelry cleaning arrangement according to claim 1, further comprising steam generation means for generating steam and for providing steam for cleaning of jewelry.

14. A jewelry cleaning arrangement according to claim 13, wherein said steam generation means includes a steam generation tank connected to a steam conduit, a valve controlling flow from said steam conduit and a flexible hose, said flexible hose issuing steam when said valve is in an open position.

15. A jewelry cleaning arrangement according to claim 14, wherein said steam generation means further includes a pressure-reducing valve and a filler cap for adding water to said steam tank.

16. A jewelry cleaning arrangement according to claim 15, wherein said pressure-reducing valve includes a ball and spring arrangement.

17. A jewelry cleaning arrangement according to claim 1, wherein said tank is at positive potential and said electrical contact member is at negative potential.

18. A jewelry cleaning arrangement according to claim 1, further comprising control means for controlling the supply of power to the electrical cleaning bath tank and electrical contact member.

* * * * *